US010731800B2

(12) United States Patent
Wang et al.

(10) Patent No.: US 10,731,800 B2
(45) **Date of Patent: *Aug. 4, 2020**

(54) LIGHTING SYSTEM WITH CUSTOMIZED INTENSITY AND PROFILE HAVING A FRAME INCLUDING LED MOUNTING PANELS MOUNTING IN ELONGATED CHANNELS OF THE FRAME AND DRIVERS MOUNTED ON THE PANELS

(71) Applicant: Orion Energy Systems, Inc., Manitowoc, WI (US)

(72) Inventors: Jun Wang, Sheboygan, WI (US); Kenneth J. Wetenkamp, Plymouth, WI (US); Matthew S. Tlachac, Manitowoc, WI (US); Neal R. Verfuerth, Manitowac, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/450,417

(22) Filed: Jun. 24, 2019

(65) Prior Publication Data

US 2019/0309934 A1 Oct. 10, 2019

Related U.S. Application Data

(63) Continuation of application No. 15/798,036, filed on Oct. 30, 2017, now Pat. No. 10,330,298, which is a (Continued)

(51) Int. Cl.
*F21K 9/65* (2016.01)
*F21V 23/00* (2015.01)
(Continued)

(52) U.S. Cl.
CPC ..... *F21K 9/65* (2016.08); *F21V 14/06* (2013.01); *F21V 17/002* (2013.01); *F21V 19/04* (2013.01);
(Continued)

(58) Field of Classification Search
CPC ..... F21V 17/002; F21V 14/00; F21V 23/06; F21V 2101/02; F21V 21/08; F21V 21/0816; F21V 21/0824; F21V 21/0832; F21V 21/084; F21V 21/088; F21V 21/0885; F21V 23/003; F21Y 2101/02; F21Y 2115/10;
(Continued)

(56) References Cited

U.S. PATENT DOCUMENTS 5,559,681 A 9/1996 Duarte
6,257,735 B1 7/2001 Baar
(Continued)

OTHER PUBLICATIONS

Finnex Advertisements and Manual, a portion of which bears a date indication of Jun. 14, 2010, 11 pages.

*Primary Examiner* — Robert J May
(74) *Attorney, Agent, or Firm* — Foley & Lardner LLP

(57) ABSTRACT

A light fixture includes a frame, a plurality of LED mounting panels that are removably coupled to the frame, a plurality of LEDs that are disposed on each of the plurality of LED mounting panels, and a plurality of drivers. Each of the plurality of drivers is disposed on a corresponding one of the plurality of LED mounting panels and is electrically coupled to the plurality of LEDs disposed on each of the plurality of LED mounting panels.

20 Claims, 8 Drawing Sheets

Related U.S. Application Data continuation of application No. 14/319,248, filed on Jun. 30, 2014, now Pat. No. 9,803,841, which is a continuation of application No. 13/769,763, filed on Feb. 18, 2013, now Pat. No. 8,764,237, which is a continuation of application No. 12/833,487, filed on Jul. 9, 2010, now Pat. No. 8,376,583.

(60) Provisional application No. 61/395,738, filed on May 17, 2010.

(51) Int. Cl.

| | |
|---|---|
| ***F21V 17/00*** | (2006.01) |
| ***H05B 45/00*** | (2020.01) |
| ***F21V 14/06*** | (2006.01) |
| ***F21V 19/06*** | (2006.01) |
| ***F21V 19/04*** | (2006.01) |
| *F21Y 103/10* | (2016.01) |
| *F21Y 115/10* | (2016.01) |
| *F21V 5/04* | (2006.01) |
| *F21V 23/02* | (2006.01) |
| *F21V 17/10* | (2006.01) |
| *F21V 17/14* | (2006.01) |
| *F21V 17/16* | (2006.01) |

(52) U.S. Cl.

CPC ..... *F21V 19/06* (2013.01); *F21V 23/005* (2013.01); *F21V 23/006* (2013.01); *H05B 45/00* (2020.01); *F21V 5/04* (2013.01); *F21V 17/104* (2013.01); *F21V 17/14* (2013.01); *F21V 17/164* (2013.01); *F21V 23/023* (2013.01); *F21Y 2103/10* (2016.08); *F21Y 2115/10* (2016.08)

(58) Field of Classification Search

CPC ..... F21Y 2103/10; F21S 4/008; F21S 2/005; F21S 4/28; F21S 4/20; F21K 9/27

See application file for complete search history.

(56) References Cited

U.S. PATENT DOCUMENTS

| | | | |
|---|---|---|---|
| D447,266 | S | 8/2001 | Verfuerth |
| D463,059 | S | 9/2002 | Verfuerth |
| 6,467,933 | B2 | 10/2002 | Baar |
| 6,580,228 | B1 | 6/2003 | Chen et al. |
| 6,585,396 | B1 | 7/2003 | Verfuerth |
| D479,826 | S | 9/2003 | Verfuerth et al. |
| D483,332 | S | 12/2003 | Verfuerth |
| 6,710,588 | B1 | 3/2004 | Verfuerth et al. |
| 6,724,180 | B1 | 4/2004 | Verfuerth et al. |
| 6,746,274 | B1 | 6/2004 | Verfuerth |
| 6,749,310 | B2 | 6/2004 | Pohlert et al. |
| 6,758,580 | B1 | 7/2004 | Verfuerth |
| D494,700 | S | 8/2004 | Hartman et al. |
| 6,774,619 | B1 | 8/2004 | Verfuerth et al. |
| 6,909,239 | B2 | 6/2005 | Gauna |
| 6,936,968 | B2 | 8/2005 | Cross et al. |
| 6,964,502 | B1 | 11/2005 | Verfuerth |
| 7,175,306 | B2 | 2/2007 | Pan |
| D538,462 | S | 3/2007 | Verfuerth et al. |
| 7,192,160 | B2 | 3/2007 | Reiff et al. |
| 7,249,865 | B2 | 7/2007 | Robertson |
| D557,817 | S | 12/2007 | Verfuerth |
| 7,307,391 | B2 | 12/2007 | Shan |
| 7,311,423 | B2 | 12/2007 | Frecska et al. |
| D560,469 | S | 1/2008 | Bartol et al. |
| 7,334,932 | B2 | 2/2008 | Klettke |
| 7,377,669 | B2 | 5/2008 | Farmer et al. |
| 7,401,942 | B1 | 7/2008 | Verfuerth et al. |
| 7,478,924 | B2 | 1/2009 | Robertson |
| 7,498,753 | B2 | 3/2009 | McAvoy et al. |
| D595,894 | S | 7/2009 | Verfuerth et al. |
| 7,563,006 | B1 | 7/2009 | Verfuerth et al. |
| 7,575,338 | B1 | 8/2009 | Verfuerth |
| D606,697 | S | 12/2009 | Verfuerth et al. |
| D606,698 | S | 12/2009 | Verfuerth et al. |
| 7,628,506 | B2 | 12/2009 | Verfuerth et al. |
| 7,638,743 | B2 | 12/2009 | Bartol et al. |
| 7,674,010 | B2 | 3/2010 | Griffiths et al. |
| 7,674,018 | B2 | 3/2010 | Holder et al. |
| 7,703,941 | B2 | 4/2010 | Lee |
| D617,028 | S | 6/2010 | Verfuerth et al. |
| D617,029 | S | 6/2010 | Verfuerth et al. |
| 7,746,003 | B2 | 6/2010 | Verfuerth et al. |
| 7,810,979 | B2 | 10/2010 | Oku |
| 7,857,497 | B2 | 12/2010 | Koike et al. |
| 7,954,979 | B2 | 6/2011 | Sommers et al. |
| 7,988,335 | B2 | 8/2011 | Liu et al. |
| 8,042,970 | B2 | 10/2011 | Wang et al. |
| 8,070,317 | B2 | 12/2011 | Zhang et al. |
| 8,142,065 | B2 | 3/2012 | Cho et al. |
| 8,240,875 | B2 | 8/2012 | Roberts et al. |
| 8,262,250 | B2 | 9/2012 | Li et al. |
| 8,360,591 | B2 | 1/2013 | Jung |
| 8,425,085 | B2 | 4/2013 | Van Laanen et al. |
| 8,506,125 | B2 | 8/2013 | Pohlert et al. |
| 8,939,634 | B2 | 1/2015 | Leadford et al. |
| 2007/0242466 | A1 | 10/2007 | Wu et al. |
| 2008/0007943 | A1 | 1/2008 | Verfuerth et al. |
| 2008/0275802 | A1 | 11/2008 | Verfuerth et al. |
| 2009/0000217 | A1 | 1/2009 | Verfuerth et al. |
| 2009/0009989 | A1 | 1/2009 | Verfuerth et al. |
| 2009/0147507 | A1 | 6/2009 | Verfuerth et al. |
| 2009/0189535 | A1 | 7/2009 | Verfuerth et al. |
| 2009/0209162 | A1 | 8/2009 | Bartol |
| 2009/0243517 | A1 | 10/2009 | Verfuerth et al. |
| 2009/0248217 | A1 | 10/2009 | Verfuerth et al. |
| 2009/0303722 | A1 | 12/2009 | Verfuerth et al. |
| 2009/0310356 | A1 | 12/2009 | Laporte |
| 2009/0315485 | A1 | 12/2009 | Verfuerth et al. |
| 2010/0026187 | A1 | 2/2010 | Kelly et al. |
| 2010/0061088 | A1 | 3/2010 | Bartol et al. |
| 2010/0156308 | A1 | 6/2010 | Maehara et al. |
| 2010/0164389 | A1 | 7/2010 | Dellian et al. |
| 2010/0165620 | A1 | 7/2010 | Marson |
| 2010/0271804 | A1 | 10/2010 | Levine |
| 2010/0315011 | A1 | 12/2010 | George et al. |
| 2011/0146669 | A1 | 6/2011 | Bartol et al. |
| 2011/0163341 | A1 | 7/2011 | Van Elmpt et al. |
| 2011/0310614 | A1 | 12/2011 | Budike, Jr. |

LIGHTING SYSTEM WITH CUSTOMIZED INTENSITY AND PROFILE HAVING A FRAME INCLUDING LED MOUNTING PANELS MOUNTING IN ELONGATED CHANNELS OF THE FRAME AND DRIVERS MOUNTED ON THE PANELS

CROSS REFERENCE TO RELATED APPLICATIONS

The present Application is a Continuation of U.S. application Ser. No. 15/798,036, filed Oct. 30, 2017, which is a Continuation of U.S. application Ser. No. 14/319,248, filed Jun. 30, 2014, which is a Continuation of U.S. application Ser. No. 13/769,763, filed Feb. 18, 2013, which is a Continuation of U.S. application Ser. No. 12/833,487, filed Jul. 9, 2010, now U.S. Pat. No. 8,376,583, which claims the benefit of priority of U.S. Provisional Patent Application No. 61/395,738, filed on May 17, 2010, the disclosures of which are incorporated herein by reference in their entireties.

FIELD

The present invention relates to a lighting and energy conservation system for use in low temperature applications (e.g. freezers, cold storage rooms, etc.). The present invention relates more particularly to a lighting and energy conservation system having a modular LED light fixture for use in freezer and other low temperature applications. The present invention relates more particularly to a modular LED light fixture having LEDs mounted on strips that are interchangeably installed in reflective channels of a body of the light fixture. The present invention relates more particularly to a modular LED light fixture having a plurality of different lenses that are interchangeably installed over each LED and mounted to the strips using a quick-connect (e.g. twist-lock) attachment device. The present invention relates more particularly to a modular LED light fixture having a multi-position power control device associated with each of the strips so that a total light output of the fixture can be individually customized for a wide variety of applications.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It would be desirable to provide an improved lighting and energy conservation system for use in low temperature applications such as commercial or industrial freezers, such as (but not limited to) warehouse-type freezers that provide a low temperature environment (e.g. within a range of approximately −20 degrees F. through +20 degrees F., etc.) for cold storage of items such as frozen food products and the like. Such low temperature applications or environments typically have relatively limited and infrequent occupancy by humans (e.g. operators or workers at the facility, etc.) due to the low temperature exposure and the nature of the environment as a storage area. Conventional light fixtures intended for use in such low temperature applications have a number of disadvantages. For example, high intensity discharge (HID) and fluorescent lighting fixtures tend operate at a lower efficiency in a low temperature environment and typically require a relatively prolonged initiation and warm-up time before the light level reaches the normal intensity. Accordingly, facility owners typically allow such fixtures to remain "on" all the time, even when the low temperature area is not occupied, so that the low temperature area will be illuminated when needed and people needing to access the area won't need to wait for the lights to warm-up. Such practices tend to be energy inefficient because energy used to continuously illuminate the fixtures is wasted when the area is unoccupied, and the added heat load from the light fixtures on the refrigeration system that cools the area is unnecessary. Also, such known fixtures are typically not configured to focus light in certain desired areas, such as from a tall ceiling downward into long aisles or passageways having tall shelves of frozen products stacked on opposite sides of the aisles. Further, such known fixtures typically do not include power or intensity control devices that can be used to customize the light output and provide for extended life of the light source of the light fixture.

Accordingly, it would be desirable to provide a lighting and energy conservation system having a light source, such as LEDs that operate more efficiently in low temperature environments. It would also be desirable to provide a modular LED light fixture for use in low temperature applications (such as freezers and the like) that permits relatively instantaneous or rapid illumination when the fixture is turned on, so that facility operators are less inclined to leave the fixtures "on" continuously, thereby reducing energy consumption by the fixture and reducing heat load contribution to the freezer from the fixtures. It would also be desirable to provide a modular LED light fixture for use in low temperature applications that includes LEDs mounted on strips that are interchangeably installed in reflective channels of a body of the light fixture. It would also be desirable to provide a modular LED light fixture for use in low temperature applications (such as freezers and the like) that includes a plurality of different lenses that are interchangeably installed over each LED for adjusting (or otherwise customizing) a light dispersion pattern/profile for each LED on each of the strips. It would also be desirable to provide a modular LED light fixture for use in low temperature applications (such as freezers and the like) that includes a quick-connect (e.g. twist-lock) attachment device for coupling the lenses to the strips. It would also be desirable to provide a modular LED light fixture for use in low temperature applications (such as freezers and the like) that includes a multi-position power control device (e.g. a switch, such as for example, a four way switch, etc.) associated with each of the strips so that a total light output of the fixture can be individually customized for a wide variety of applications by adjusting the power to each of the strips.

SUMMARY

According to one embodiment of the invention, a light fixture includes a frame, a plurality of LED mounting panels that are removably coupled to the frame, a plurality of LEDs that are disposed on each of the plurality of LED mounting mounting panels, and a plurality of drivers. Each of the plurality of drivers is disposed on a corresponding one of the plurality of LED mounting panels and is electrically coupled to the plurality of LEDs disposed on each of the plurality of LED mounting panels.

According to another embodiment, a light system includes a frame configured to be retrofit with a light fixture.

The light fixture includes a LED mounting panel configured to be removably coupled to the frame, a plurality of LEDs disposed on the LED mounting panel, and a power control device disposed on the LED mounting panel and configured to selectively vary an amount of power applied to the plurality of LEDs. A total light output intensity and profile of the light fixture can be customized by selectively adjusting the power control device.

According to yet another embodiment, a light system includes a frame configured to be retrofit with a light fixture. The light fixture includes a LED mounting panel configured to be removably coupled to the frame, a plurality of LEDs disposed on the LED mounting panel, a driver disposed on the LED mounting panel and electrically coupled to the plurality of LEDs, and a lens panel coupled to the LED mounting panel and covering the plurality of LEDs. The frame and the LED mounting panel are configured such that the LED mounting panel can be installed into, and uninstalled from, the frame without the use of tools.

DETAILED DESCRIPTION

Figures 1A, 1B:
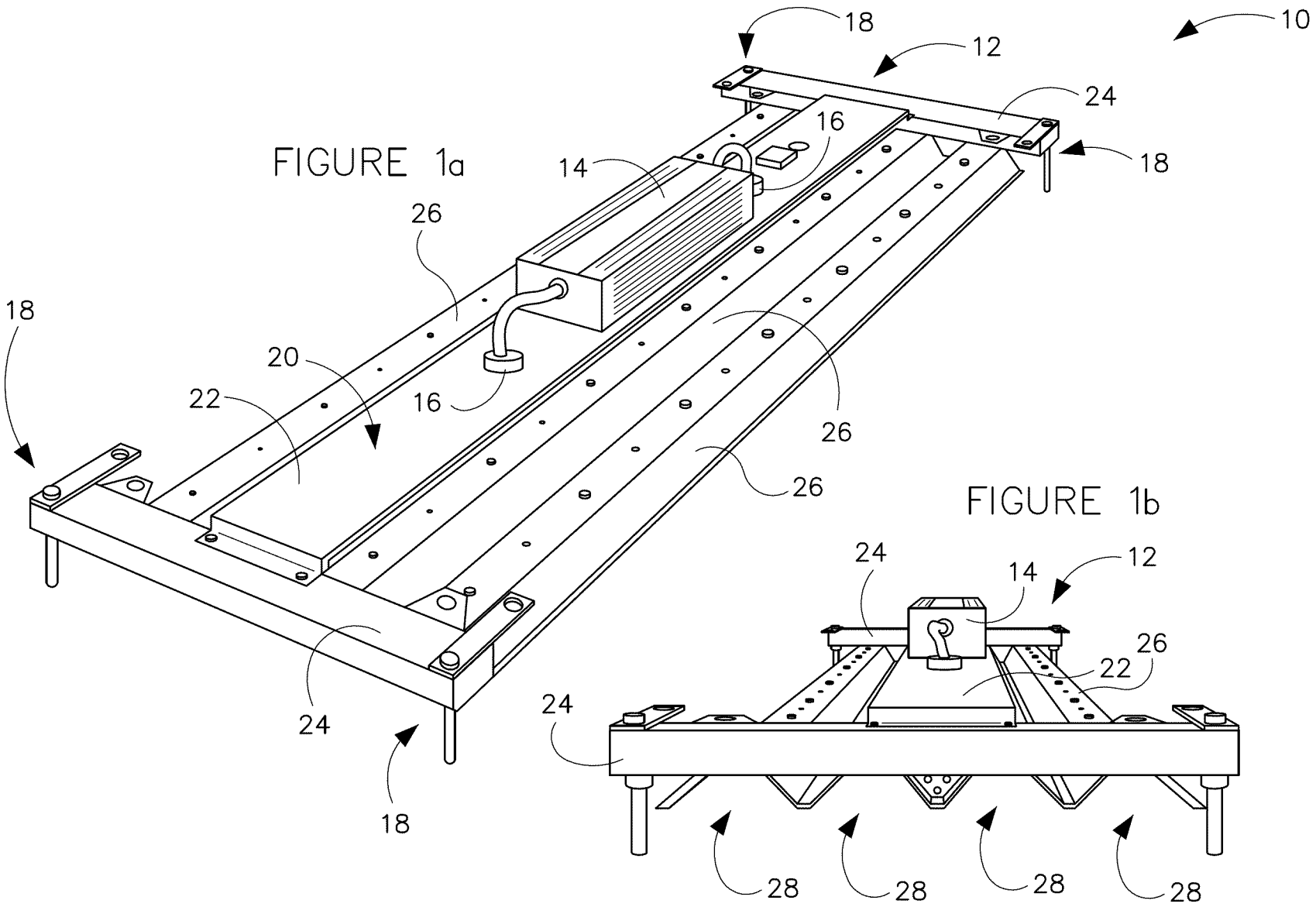
FIGS. 1*a*-1*b* are schematic images of perspective views of a top side of a modular LED light fixture for a lighting and energy conservation system for low temperature applications according to an exemplary embodiment.

Referring to the FIGURES, a lighting and energy conservation system 10 for a low temperature storage area is shown according to an exemplary embodiment. The system includes light emitting diodes (LEDs) as a source of light because LEDs operate more efficiently in low temperature environments, than conventional HID and fluorescent lighting fixtures. The LED light source is provided in a modular LED light fixture having a relatively instantaneous or rapid illumination response time which overcomes the disadvantages of the conventional HID and fluorescent lighting fixtures that require a relatively prolonged initiation and warm-up time before the light level reaches the normal intensity. Accordingly, facility operators may be less inclined to leave such fixtures "on" all the time, even when the area is unoccupied, because there is no longer a significant delay or wait-time for illumination to occur upon turning on the lights. The relatively instant-on nature of the modular LED light fixture to provide full brightness allows the light fixtures to be turned-off when access to the freezer is not desired, thus enhancing efficiency by conserving energy that would otherwise be used by the light fixture, and reducing or eliminating the heat contribution to the freezer from the light fixtures, that must otherwise be overcome by the refrigeration system.

Referring further to the FIGURES, a modular LED light fixture 12 for a lighting and energy conservation system 10 for a low temperature storage area is shown according to an exemplary embodiment. The modular LED light fixture 12 is intended to provide an energy efficient lighting solution for low-temperature applications (such as cold storage rooms, freezers and the like). The modular LED light fixture 12 is shown to include a frame 20 (shown by way of example as an I-beam type frame having a spine 22 and generally perpendicular raceways 24 disposed at opposite ends of the spine 22) supporting one or more reflectors 26 having elongated channel(s) 28. Mounting strips 30 are removably installed in each of the elongated channels 28, and LEDs 32 are mounted on each of the mounting strips 30. Interchangeable lenses 34 are provided over the LEDs 32 and are removably coupled to the mounting strip 30 by a quick-connect device 36. A separate multi-position power control device 40 is associated with each of the mounting strips 30, so that a total light output intensity and profile of the fixture 12 can be individually customized by any one or more of: interchanging lenses 34 on the LEDs 32, interchanging mounting strips 30 within the elongated channels 28, and selectively adjusting the multi-position power control device 40 for each of the mounting strips 30. Although particular lens types and quick-connect devices are shown by way of example in FIGS. 5-8, any of a wide variety of lenses having other optical properties, and other types of quick-connect devices for mounting the lens 34 over the LEDs 32 and to the mounting strips 30 may be provided. Further, interchangeable "lens strips" that covers multiple LEDs may be provided for use with the LEDs and mounting strips. In addition, the modular fixture for low temperature applications may be equipped (or operably associated) with sensors, such as occupancy sensors (e.g. motion, infrared, etc.) that are operable to turn the fixture on/off depending upon occupancy within the low temperature space. Further, the modular fixture for low temperature applications may be equipped (or operably associated) with radio frequency communication devices configured to communicate with a master control device to control operation of the fixture and communicate an operating status of the fixture to the control device. All such variations are intended to be within the scope of this disclosure.

Figure 3:
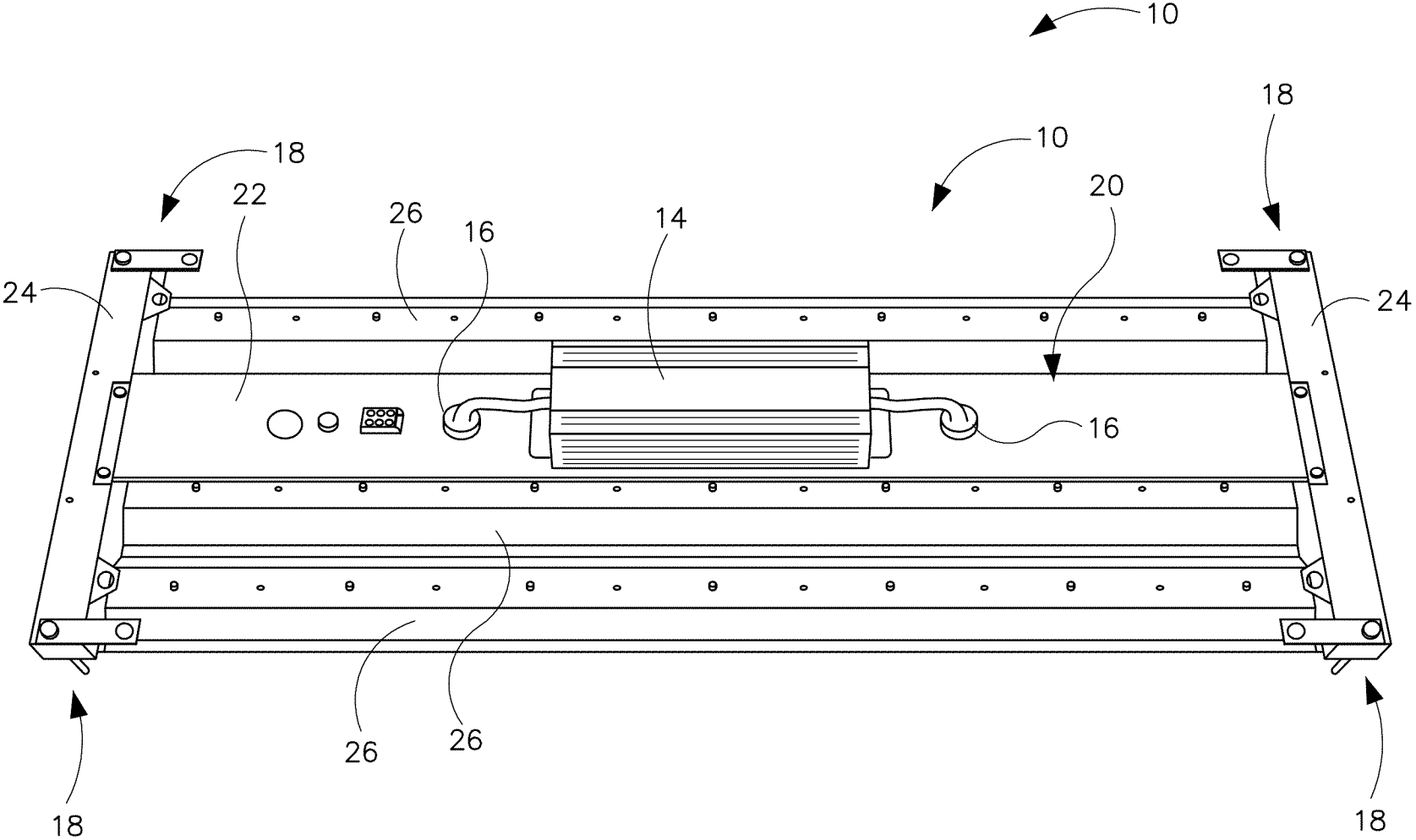
FIG. 3 is a schematic image of another perspective view of a top side of a modular LED light fixture for a lighting and energy conservation system for low temperature applications according to an exemplary embodiment.

Referring to FIGS. 1*a*, 1*b*, and 3, a structure for a modular LED light fixture intended for use in low temperature applications is shown according to an exemplary embodiment. Such low temperature applications are intended to include cold storage facilities (e.g. rooms, warehouses, etc.) having a low temperature space for storage of cold (e.g. refrigerated, frozen, etc.) products, such as food products therein. The fixture includes a frame 20 (shown for example as an I-beam type frame having a central spine portion 22 with oppositely disposed, substantially perpendicular, end portions shown as raceways 24. The spine portion 22 is shown to include mounting structure for certain components of the fixture. For example, a power supply 14 has quick-connect plugs 16 and is mounted using threaded connectors (although the mounting may be accomplished using snap-fit or frictional/interference type connections). The end portions or raceways 24 may include hardware 18 for mounting, suspending or otherwise installing the fixtures 12 within a low temperature space. The end portions or raceways 22 are also shown to support any number of a plurality of reflective channels 28 to suit the light output intensity requirements for a particular low temperature lighting application. For example, the number of reflective channels may be two, four, six, eight, or other suitable number of reflective channels (shown for example as four reflective channels 28 in FIGS. 1*a,* 1*b,* and 3). The frame is shown to be a generally "open" type frame having an exposed surface along the top side of the reflectors and the frame to permit rapid and efficient convective transfer of heat conducted from the LEDs 32 and through the mounting strips 30 and reflectors to the surrounding low temperature space. The bottom side of the reflective channels 28 (i.e. the side adjacent to the LEDs) may be provided with a reflective coating to enhance the reflection and dispersion of light from the LEDs. Such a coating may be a white thermosetting powder coating of a type described in U.S. patent application Ser. No. 12/748,323 titled "Reflector with Coating for a Fluorescent Light Fixture" filed on Mar. 26, 2010, the disclosure of which is hereby incorporated by reference in its entirety. Further, the top side of the reflective channels 28 and frame 20 may be provided with a high emissivity coating, in order to enhance radiative heat transfer away from the fixture 12 to the low temperature space. According to one embodiment, the fixture 12 including the frame 20 and reflective channels 28 is suitable for use with fluorescent light bulbs as a fluorescent light fixture, and may be retrofit with the LED components described herein to create the modular LED light fixture for low-temperature applications.

Figure 2:
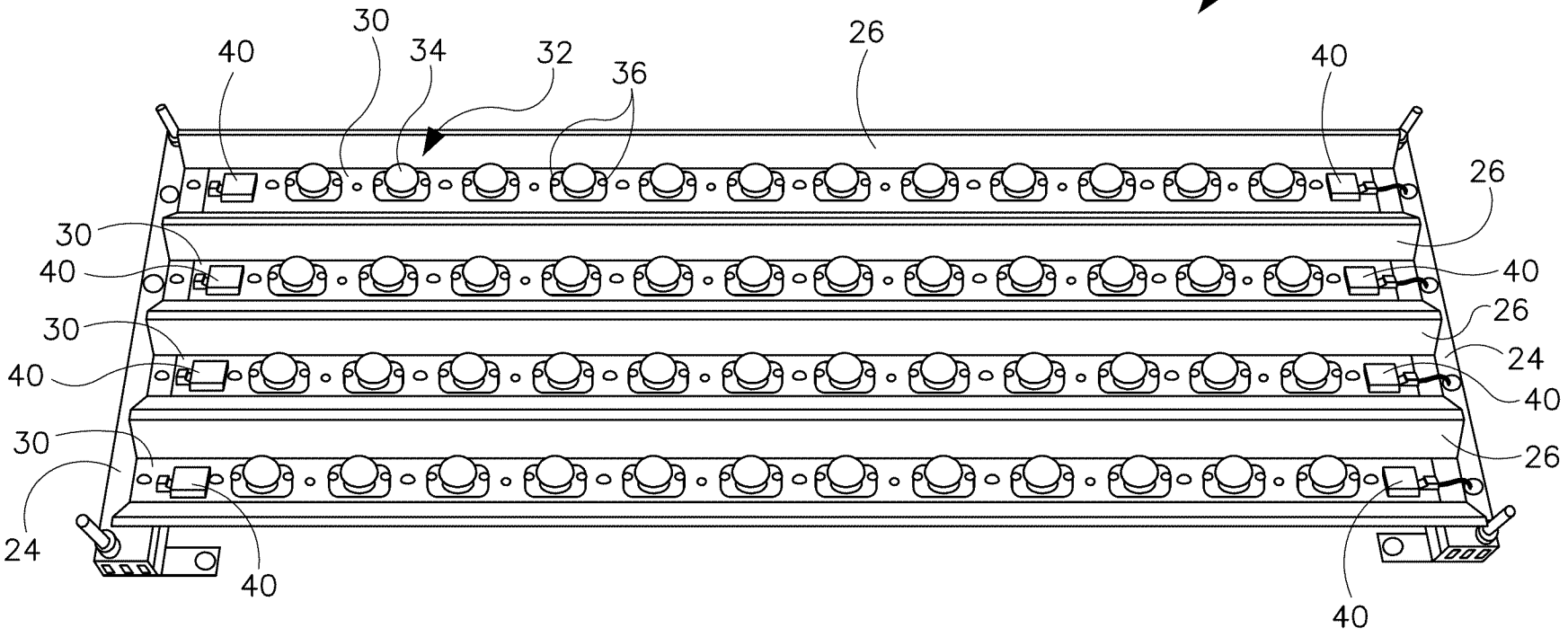
FIG. 2 is a schematic image of a perspective view of a bottom side of a modular LED light fixture for a lighting and energy conservation system for low temperature applications according to an exemplary embodiment.
Figure 4:
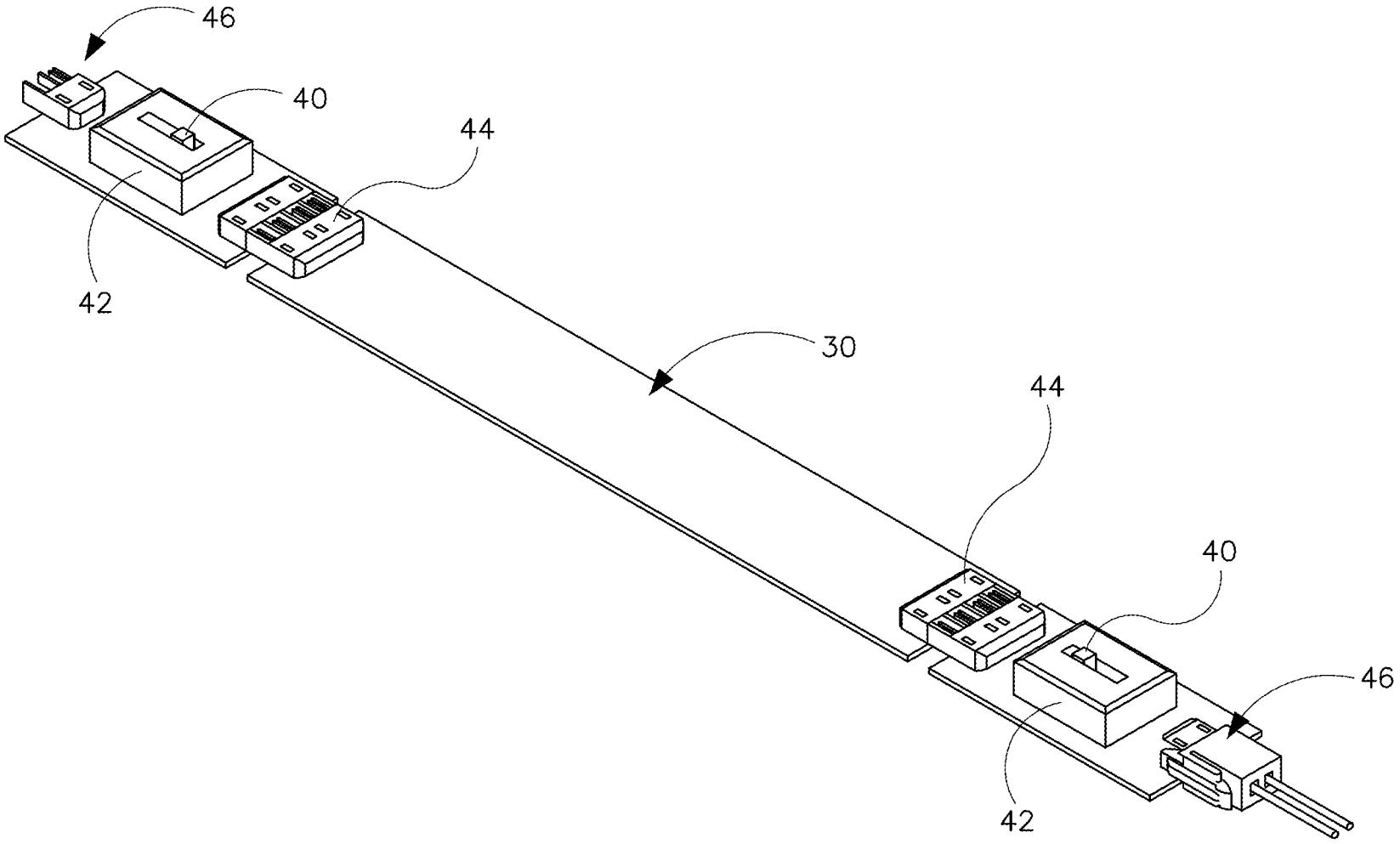
FIG. 4 is a schematic image of a perspective view of an LED mounting strip with connector, driver, multi-position power control device, and power supply connector.

Referring to FIGS. 2 and 4, the components of the modular LED light fixture 12 for low temperature applications are shown according to an exemplary embodiment. The fixture 12 is shown to include a plurality of elongated reflective channels 28 (shown for example as four reflective channels). A plurality of LED mounting strips 30 (shown for example as four LED mounting strips) are mounted or otherwise disposed within the reflective channels 28, and containing a plurality of LEDs 32 (e.g. white LEDs, etc.) incrementally spaced and mounted therealong for providing a source of light output for the fixture 12. According to the illustrated embodiment, the LED mounting strips 30 and the reflective channels 28 have approximately the same length and one LED mounting strip 30 is provided in each reflective channel 28, however, other combination of mounting strips and reflective channels may be used in alternative embodiments. The mounting strips 30 are removable coupled within each channel 28 so that the mounting strips 30 may be quickly and easily exchanged or replaced to permit individually customizing the fixture 12 for a particular application. According to the illustrated embodiment, the strips 30 are mounted at each end to the reflector 26 and/or end portion 24 of the frame 20 using suitable connecters (e.g. threaded connectors, etc.), however, the strips may be mounted using snap-fit, sliding, or interference type connection to provide "tool-less" modular interchangeability of the mounting strips. According to a preferred embodiment, at least a portion of the mounting strips 30 are in contact with the reflector 26 in order to provide a conductive heat transfer path from the LEDs to the body of the reflectors 26 for transfer of heat away from the reflectors 26 and the fixture 12.

Referring further to FIGS. 2 and 4, the mounting strips 30 are also shown to include drivers 42 mounted thereon for driving the LEDs 32. As shown by way of example in FIG. 4, the drivers 42 are coupled to the LED mounting strips using a connector 44, such as a quick-disconnect type connector to facilitate easy and rapid replacement of the drivers 42 and switches 40 if necessary, without having to remove and/or replace the mounting strip 30 with LEDs and lenses (e.g. as a time and cost-savings feature). The drivers 42 are also mounted for quick and easy replacement, such as by using suitable connecters (e.g. threaded connectors, etc.), however, the drivers may be mounted using snap-fit, sliding, or interference type connection to provide "tool-less" replacement of the drivers. The drivers are also shown to receive power (e.g. 24 VDC, etc.) from a power source via a hard wired connector that connects to the driver using a quick-disconnect type of connector 46. The multi-position power control device 40 is shown mounted on (or otherwise incorporated with) the driver 42 and permits adjustment of the light output from the LEDs on the associated LED mounting strip 30. The multi-position power control device 40 may include a four-position switch to fine tune the light output intensity level (e.g. 3.75 percent incrementally until about 30%). The multi-position power control device 40 may be associated with a single LED mounting strip 30 (as shown in FIG. 4) to permit light output adjustment at a mounting strip level within each fixture 12, or a single multi-position power control device may be associated with all mounting strips within the fixture. According to one embodiment, multi-position power control device 40 uses pulse width modulation, so that the adjustment will not unnecessarily consume (e.g. waste, etc.) energy. The four-position switch is also intended to improve the lifetime of the fixture without wasting energy. Referring further to FIG. 4, the mounting strips 30 are shown as being configured in a substantially symmetric manner, such that an intermediate portion contains the LEDs and lenses, and end portions each include the multi-position power control device 40, the driver 42, the driver connectors 44 and the quick-disconnect 24 VDC power connectors 46. The symmetry of the mounting strip components is intended to enhance production and minimize assembly errors by permitting the strip to be installed in either orientation and yet still be entirely functional. The modularity of the mounting strips 30 with quick-disconnect end portions with the driver components is also intended to permit replacement of one driver with another (e.g. different) driver, such as a dimmable driver or the like, to suit other applications, such as applications where a dimmable light fixture is desirable.

The LED mounting strips 30 are further shown to include lenses 34 disposed over each LED 32 and coupled to the mounting strip 30 by a quick-connect device or mechanism for rapid modular interchangeability of lenses having different optical characteristics to permit individually customizing the fixture to suit the light output profile requirements of a particular application. The ability to customize the fixture with lenses having any one or more (e.g. mix, match, etc.) of different optical characteristics provides a degree of modularity to the fixture that is intended to produce focused, high performance, energy efficient lighting in low temperature applications. In order to support manufacturing and maintenance (or retrofit) operations, the LED mounting strips 30 may be provided with various standard patterns of lens types that have been evaluated and tested to provide desired light output profiles, so that customization may be provided on a 'macro' level by replacing strips or adding additional strips and reflectors to the frame, or may be provided on a 'micro' level by interchanging lenses individually (or in groups, etc.).

Figure 5:
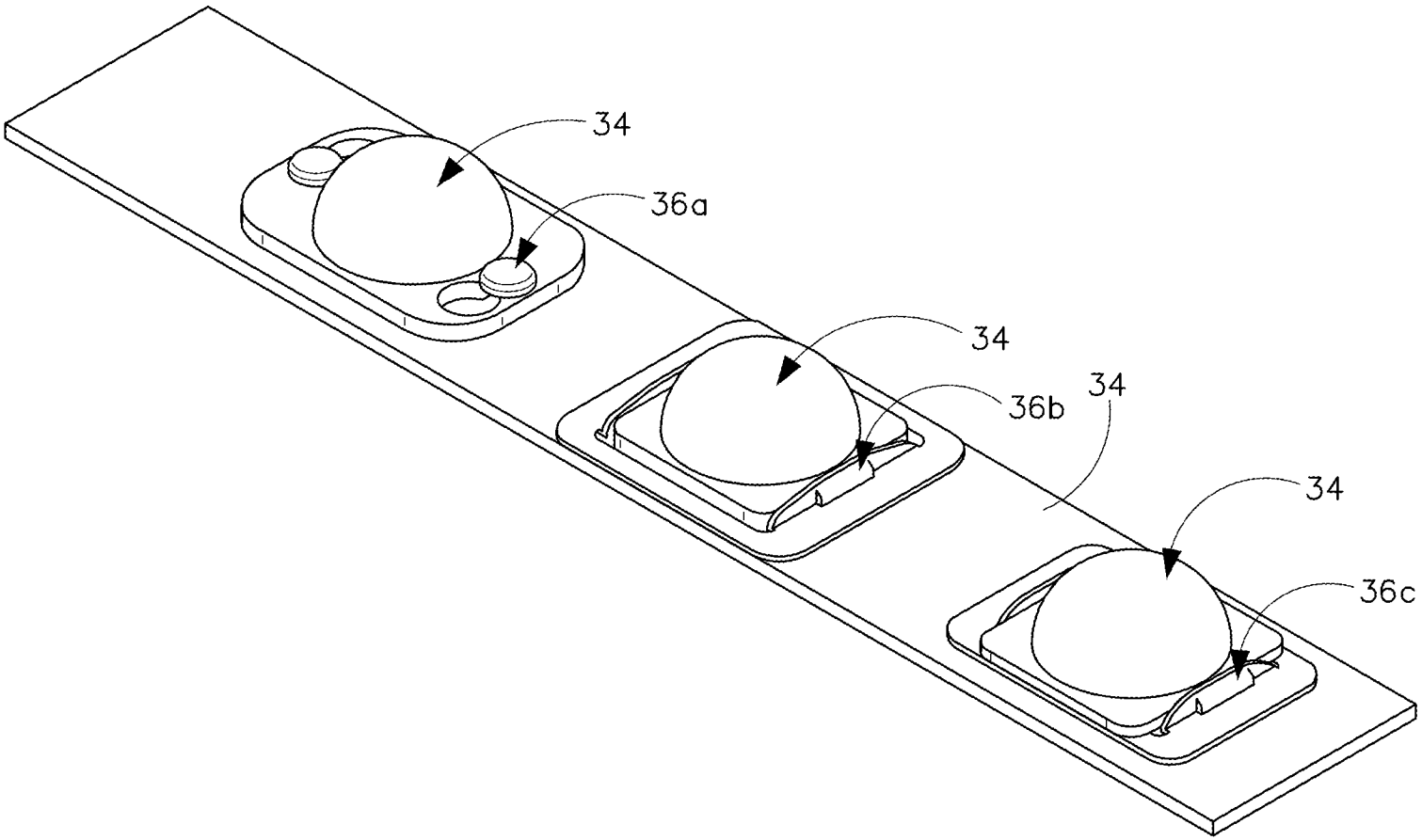
FIG. 5 is a schematic image of a perspective view of a portion of an LED mounting strip, with lenses disposed over the LEDs and various quick-connect devices to mount the lenses to the mounting strip of a modular LED light fixture according to an exemplary embodiment.

Referring to FIG. 5, the lenses are shown to be coupled to the LED mounting strips using any one of a plurality of quick-connect devices 36, according to an exemplary embodiment. According to a first embodiment, the lenses 34 are shown to attach to the LED mounting strip using a twist-lock type connection 36*a* having one or more (shown for example as two) projections extending from the mounting strip and adapted to releasably engage corresponding openings or recesses on a flange portion of the lenses. According to a second embodiment, the lenses 34 are shown to attach to the LED mounting strip 30 using a slide-lock type connection 36*b* having rails or tabs extending from the mounting strip and adapted to slidably receive the edges of the flange portion of the lenses. According to a third embodiment, the lenses 34 are shown to attach to the LED mounting strip 30 using a snap-fit type connection 36*c* having one or more (shown for example as two) resilient tabs (e.g. with hooks, etc.) extending from the mounting strip and adapted to releasably engage the flange portion of the lenses.

Figure 6:
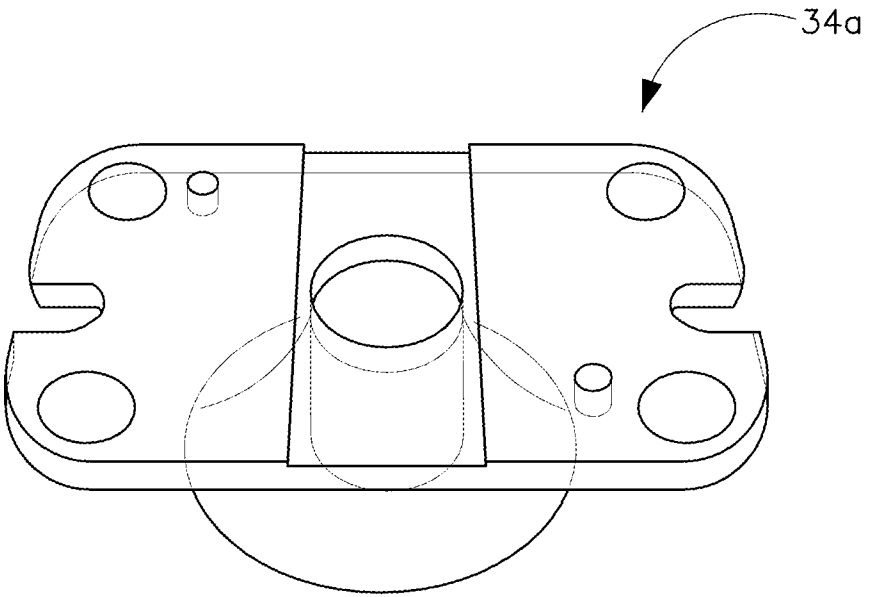
FIG. 6 is a schematic image of a perspective view of one lens for directing a profile of light from an LED on an LED mounting strip of a modular LED light fixture according to an exemplary embodiment.

Referring to FIG. 6, one type of lens is shown for use with a modular LED light fixture for low temperature applications according to an exemplary embodiment. The lens 34*a* is shown having a flange portion (for engaging the LED mounting strip) and an opening for directing light emitted from the associated LED to a open dish-type (e.g. parabolic, etc.) diffuser. The geometry of the diffuser may be any of a wide variety of geometries intended to provide a specific light dispersion profile.

Figure 7:
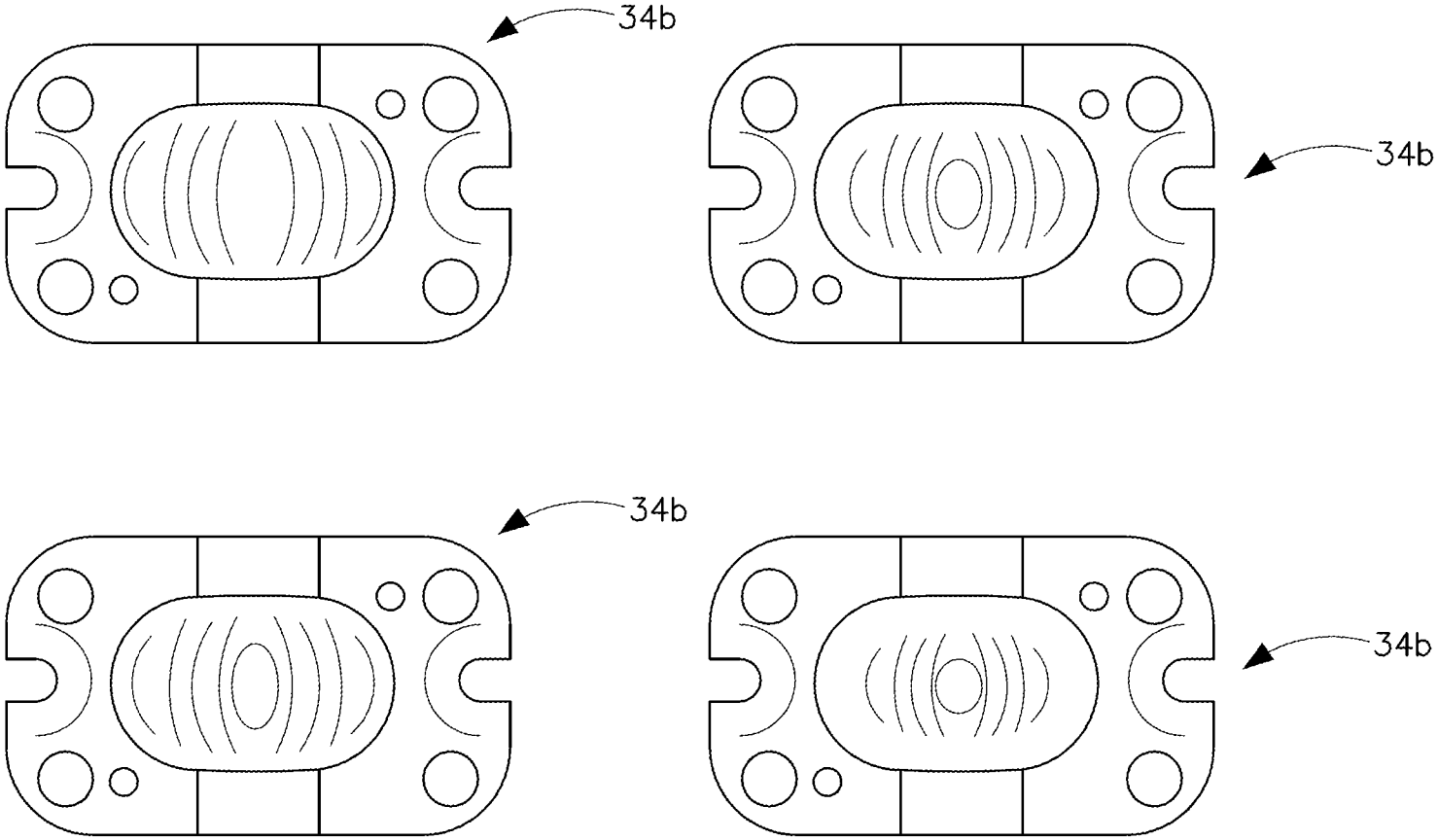
FIG. 7 is a schematic image of perspective views of more lenses for directing different profiles of light from an LED on an LED mounting strip of a modular LED light fixture according to an exemplary embodiment.

Referring to FIG. 7, another type of lens is shown for use with a modular LED light fixture for low temperature applications according to an exemplary embodiment. The lens 34*b* is shown having a flange portion (for engaging the LED mounting strip) and a closed diffuser in the shape on an elongated dome-like structure (shown by way of example with varying degrees of length and curvature) for directing light emitted from an associated LED in a particular light dispersion profile.

Figure 8:
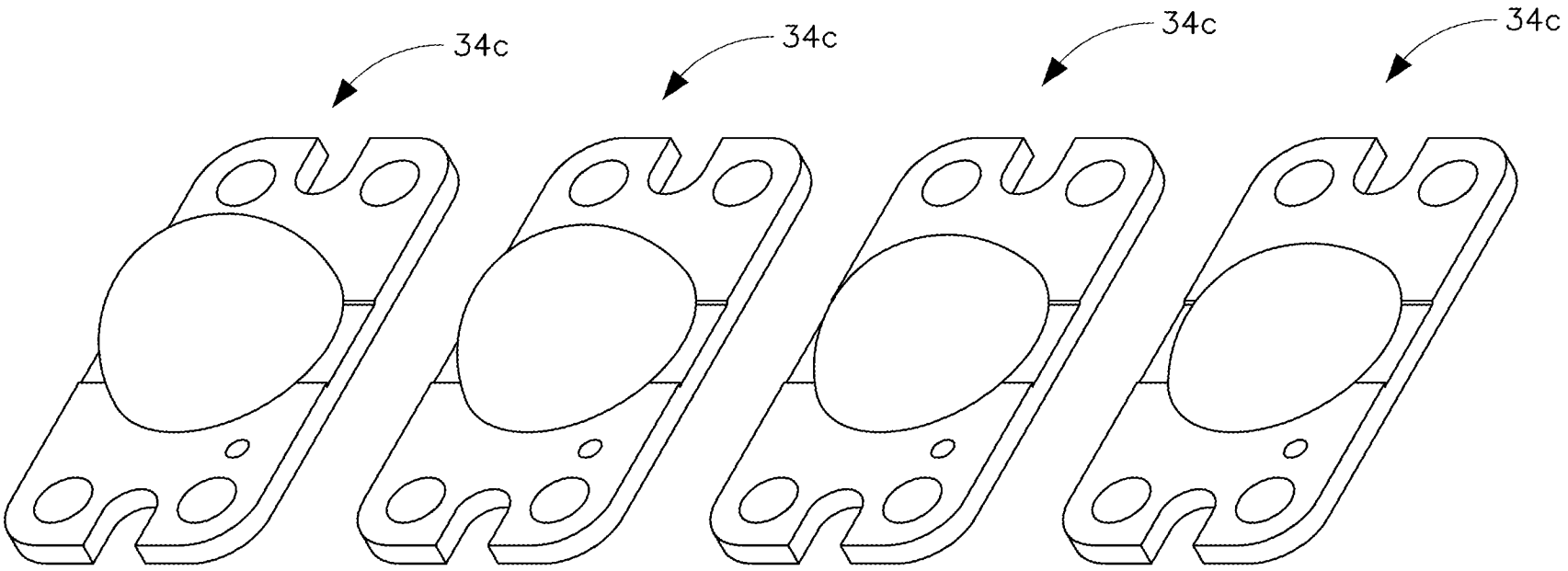
FIG. 8 is a schematic image of perspective views of yet more lenses for directing different profiles of light from an LED on an LED mounting strip of a modular LED light fixture according to an exemplary embodiment.

Referring to FIG. 8, yet another type of lens is shown for use with a modular LED light fixture for low temperature applications according to an exemplary embodiment. The lens 34*c* is shown having a flange portion (for engaging the LED mounting strip) and a closed diffuser in the shape on a substantially circular dome-like structure (shown by way of example with varying degrees of curvature) for directing light emitted from an associated LED in a particular light dispersion profile. Although only several examples of lenses have been illustrated in the embodiments of the present application, any of a wide variety of lenses may be used in any particular pattern or combination to support the modularity of the fixture to be adapted or customized to suit a particular low temperature lighting application.

According to any exemplary embodiment, a lighting and energy conservation system for low temperature applications includes a modular LED light fixture having interchangeable lenses for LEDs on mounting strips mounted within elongated reflective channels in the fixture body. According to one embodiment, the low temperature application includes warehouse-type freezers or similar cold storage facilities, having long aisles, tall ceilings and tall stacks or racks of products on each side of the aisles. For example, such an aisle may be approximately 40 feet high and 10 feet wide, or 30 feet high and 10 feet wide, or any other dimension suited to stacking and cold-storing products in a readily retrievable manner. The property of an LED providing a point source of light makes the LED well-suited for providing effective illumination for such a challenging application. By providing a plurality of lenses having different optical characteristics, light output profiles can be individually customized to direct the light to where it is most needed. For example, in such warehouse freezer aisle applications, the light output can be directed primarily toward the aisle floor and the vertical plane of the racks, rather than being wasted on other unnecessary locations.

Further, the modular nature of the fixture permits any number of reflective channels, with LED mounting strips disposed therein (e.g. two, four, six, eight, etc.) as needed to accommodate a particular application. The multi-position power control device may include a four-position switch to fine tune the light output intensity level (e.g. 3.75 percent incrementally until about 30%). According to one embodiment, multi-position power control device uses pulse width modulation, so that the adjustment will not waste energy. The four-position switch is also intended to improve the lifetime of the fixture without wasting energy. It is generally understood that lifetime of an LED is defined as 30% lumen depreciation. Accordingly, through use of the multi-position power control device for each LED mounting strip, the light output intensity may be set at 70 percent initially and as the LEDs in the fixture approach an end of life condition (e.g. 70 percent of initial lumen), the multi-position power control device can be adjusted back to 100 percent light output intensity to maintain the desired light output intensity over a longer lifetime without initially wasting energy. In order to further enhance the lifetime of the other components of the modular fixture (to approach the enhanced life of the LEDs), the fixture includes features that improve and facilitate the ease of serviceability, because the life of the fixture is determined by the life of all of its components. The fixture includes a readily replaceable power supply (e.g. snap-in or attached by threaded connectors). Also, the LED driver is arranged as a plug-in device that is easily and readily replaced. The LED mounting strips are also mounted using snap-in (plug and play) or easily accessed threaded connectors). The modular fixture is also shown to include an open structure for enhanced convention heat transfer and a coated structure for enhanced radiation heat transfer of the heat generated by the LEDs.

The relatively instant-on nature of the modular LED light fixture of the lighting and energy conservation system is intended to allow the light fixtures to be turned-off when access to the freezer is not desired, thus enhancing efficiency by conserving energy that would otherwise be used by the light fixture, and reducing or eliminating the heat contribution to the freezer from the light fixtures, that must otherwise be overcome by the refrigeration system.

It is also important to note that the construction and arrangement of the elements of the modular low temperature LED light fixture as shown (schematically or otherwise) in the embodiments is illustrative only. Although only a few embodiments have been described in detail in this disclosure, those skilled in the art who review this disclosure will readily appreciate that many modifications are possible without materially departing from the novel teachings and advantages of the subject matter recited.

Accordingly, all such modifications are intended to be included within the scope of the present invention. Other substitutions, modifications, changes and omissions may be made in the design, operating conditions and arrangement of the preferred and other exemplary embodiments without departing from the spirit of the present invention.

Unless otherwise indicated, all numbers used in the specification and claims are to be understood as being modified in all instances by the term "about." Accordingly, unless indicated to the contrary, the numerical parameters set forth in the following specification and attached claims are approximations that may vary depending at least upon the specific analytical technique, the applicable embodiment, or other variation according to the particular configuration of the reflector and coating.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present invention as expressed in the appended claims.

What is claimed is:

1. A light fixture, comprising:

a frame having a plurality of elongated channels;

a plurality of LED mounting panels removably coupled to the frame, wherein the plurality of LED mounting panels is located within one of the plurality of elongated channels, and wherein each of the plurality of LED mounting panels is in contact with the frame; and a plurality of LEDs disposed on each of the plurality of LED mounting panels; and a plurality of drivers, each of the plurality of drivers disposed on a corresponding one of the plurality of LED mounting panels and electrically coupled to the plurality of LEDs disposed on each of the plurality of LED mounting panels.

2. The light fixture of claim 1, wherein each of the plurality of LED mounting panels is in contact with the frame along an entire length of each of the plurality of LED mounting panels.

3. The light fixture of claim 1, wherein the frame and the plurality of LED mounting panels are configured such that each of the plurality of LED mounting panels can be removed from the frame without the use of tools.

4. The light fixture of claim 3, wherein each of the plurality of LED mounting panels defines opposing end portions, and wherein each opposing end portion is removably coupled to the frame.

5. The light fixture of claim 1, a plurality of power controllers, each of the plurality of power controllers disposed on, and configured to selectively vary an amount of power applied to, one of the plurality of LED mounting panels;

wherein a total light output intensity and profile of the light fixture can be customized by selectively adjusting one of the plurality of power controllers.

6. The light fixture of claim 5, wherein each of the plurality of drivers is coupled to one of the plurality of power controllers.

7. The light fixture of claim 5, wherein each of the plurality of power controllers includes at least three positions corresponding to at least three different lighting intensity levels.

8. The light fixture of claim 5, further comprising an occupancy sensor coupled to each of the plurality of power controllers;

wherein the occupancy sensor selectively causes at least one of the plurality of power controllers to change states.

9. The light fixture of claim 5, wherein each of the plurality of LED mounting panels defines opposing end portions;

wherein each of the plurality of drivers is disposed on one of the opposing end portions; and wherein each of the plurality of power controllers is disposed on one of the opposing end portions.

10. The light fixture of claim 1, wherein each of the plurality of LED mounting panels defines opposing end portions; and wherein each of the plurality of drivers is disposed on one of the opposing end portions.

11. A light system comprising:

a frame configured to be retrofit with a light fixture, the frame comprising an elongated channel, the light fixture comprising:

a LED mounting panel configured to be removably coupled to the frame, wherein the LED mounting panel is configured to be located within the elongated channel when coupled to the frame;

a plurality of LEDs disposed on the LED mounting panel; and a power control device disposed on the LED mounting panel and configured to selectively vary an amount of power applied to the plurality of LEDs;

wherein a total light output intensity and profile of the light fixture can be customized by selectively adjusting the power control device.

12. The light fixture of claim 11, wherein the LED mounting panel is in contact with the frame along an entire length of the LED mounting panel.

13. The light system of claim 11, wherein the light fixture further comprises a driver disposed on the LED mounting panel and electrically coupled to the plurality of LEDs and the power control device.

14. The light system of claim 13, wherein the LED mounting panel defines opposing end portions;

wherein the power control device is disposed on one of the opposing end portions; and wherein the driver is disposed on one of the opposing end portions.

15. The light system of claim 11, wherein the light fixture further comprises an occupancy sensor coupled to the power control device; and wherein detected occupancy causes the power control device to change states.

16. The light system of claim 11, wherein the frame and the LED mounting panel are configured such that the LED mounting panel can be installed into, and uninstalled from, the frame without the use of tools.

17. The light fixture of claim 16, wherein the LED mounting panel defines opposing end portions, and wherein the opposing end portions are removably coupled to the frame.

18. A light system comprising:

a frame configured to be retrofit with a light fixture, the frame comprising an elongated channel, the light fixture comprising:

a LED mounting panel configured to be removably coupled to the frame, wherein the LED mounting panel is configured to be located within the elongated channel when coupled to the frame;

a plurality of LEDs disposed on the LED mounting panel;

a driver disposed on the LED mounting panel and electrically coupled to the plurality of LEDs; and a lens panel coupled to the LED mounting panel and covering the plurality of LEDs;

wherein the frame and the LED mounting panel are configured such that the LED mounting panel can be installed into, and uninstalled from, the frame without the use of tools.

19. The light fixture of claim 18, wherein the LED mounting panel defines opposing end portions, and wherein the opposing end portions are removably coupled to the frame.

20. The light system of claim 18, wherein the light fixture further comprises a power control device disposed on the LED mounting panel and configured to selectively vary an amount of power applied to the plurality of LEDs;

wherein a total light output intensity and profile of the light fixture can be customized by selectively adjusting the power control device.

* * * * *